US006829810B2

(12) United States Patent
Riedel

(10) Patent No.: US 6,829,810 B2
(45) Date of Patent: Dec. 14, 2004

(54) SUPPORT FOR A COMBING MEANS FOR AN OPENING ROLLER AND METHOD OF MAKING AND USING SAME

(75) Inventor: Frank Riedel, Ebersbach (DE)

(73) Assignee: Maschinenfabrik Rieter AG, Winterthur (CH)

( * ) Notice: Subject to any disclaimer, the term of this patent is extended or adjusted under 35 U.S.C. 154(b) by 15 days.

(21) Appl. No.: 10/372,107

(22) Filed: Feb. 25, 2003

(65) Prior Publication Data

US 2003/0159253 A1 Aug. 28, 2003

(30) Foreign Application Priority Data

Feb. 26, 2002 (DE) ..... 102 09 008

(51) Int. Cl.[7] ..... D01G 19/00
(52) U.S. Cl. ..... 19/115 R; 19/215
(58) Field of Search ..... 19/98, 99, 100, 19/112, 114, 115 A, 115 B, 115 R, 122, 123, 124 R, 215–219, 229, 233, 234, 235, 129 R, 65 R, 105; 57/408–413

(56) References Cited

U.S. PATENT DOCUMENTS 3,800,520 A * 4/1974 Schiltknecht ..... 57/411
4,135,355 A * 1/1979 Stewart ..... 57/408
5,423,176 A * 6/1995 Stahlecker et al. ..... 57/408
5,555,714 A * 9/1996 Mladek et al. ..... 57/408
5,566,541 A * 10/1996 Stahlecker et al. ..... 57/408
5,689,946 A * 11/1997 Schmid ..... 57/408
5,775,086 A * 7/1998 Stahlecker ..... 57/408
6,061,877 A * 5/2000 Leifeld et al. ..... 19/105
6,226,838 B1 * 5/2001 Raasch ..... 19/115 R

FOREIGN PATENT DOCUMENTS

DE 1 939 683 9/1970
GB 1 234 327 6/1971

* cited by examiner

*Primary Examiner*—Gary L. Welch
(74) *Attorney, Agent, or Firm*—Crowell & Moring LLP

(57) ABSTRACT

A support for a combing means for an opening roller comprises an opening roller combing means, which is designed as a saw-toothed helix having multiple thread grooves. The number of threads amounts to approximately between one twentieth and one thirthieth (expressed in millimeters) of the outer diameter of the opening means. In addition, the angle of inclination (expressed in degrees) of the helix amounts to between 0.5 and 0.7 times the number of threads. The angle of inclination of the helix should not exceed 2.5°.

9 Claims, 3 Drawing Sheets

SUPPORT FOR A COMBING MEANS FOR AN OPENING ROLLER AND METHOD OF MAKING AND USING SAME

BACKGROUND AND SUMMARY OF THE INVENTION

This application claims the priority of German Application 10209008.4 filed Feb. 26, 2002, the disclosure of which is expressly incorporated by reference herein.

The present invention relates to a support for a combing means for an opening roller, comprising an opening means designed as a saw-toothed-shaped helix having multiple thread grooves.

A support for a combing means of this type is prior art in German published patent application 19 39 683 (corresponding GB 1234327). The known support is affixed to a base body of the opening roller in a way in which it can be exchanged, and comprises a saw-toothed-like combing means, which is cut out of the metal in one piece. Thus saw teeth occur which are formed on the one hand by grooves extending helix-like, and on the other hand by recesses which extend diagonally thereto. The combing means in the form of a helix can have multiple thread grooves. The known publication does not, however, cite any criteria for the threads.

Opening rollers are applied first and foremost in open-end spinning machines and comprise today supports for combing means whose outer circumference measures in practice between 60 and 80 mm. In modern spinning aggregates, the fiber speed increases from zero at the combing zone to approximately 15 m per second at an area where the opened single fibers leave the opening means and are fed to a twisting device, for example an open-end spinning rotor. The standard average peripheral speed for opening rollers lies today in the range of 25 m per second. This means that the opening means has a significantly higher peripheral speed than the speed of the single fibers at the place where they leave the opening means. As the speed of the single fibers is largely dependent on the air current rotating with the opening roller, it would be desirable if the opening roller were to rotate slower than is usual. This, however, would reduce the combing performance.

In principle, a helix-shaped opening means having multiple thread grooves could provide a solution, because during one rotation of the opening roller, a plurality of teeth would be involved at one and the same combing place. This, unfortunately, means that because of the plurality of threads of the opening means, the angle of inclination of the helix would have to be increased, which renders the combing means much more aggressive and as a result causes damage to the fiber material to be opened.

It is an object of the present invention to find a compromise solution for the contradictory requirements mentioned above. On the one hand, the speed of the opening roller should be reduced by means of a plurality of threads, while on the other hand the aggressiveness of the combing means should be held at acceptable levels.

This object has been achieved in accordance with the present invention in that the number of threads amounts to between one twentieth and one thirtieth of the outer diameter (measured in millimeters) and that the angle of inclination (measured in degrees) of the helix amounts to between 0.5 to 0.7 times the number of threads. Caution should also be taken that the angle of inclination of the helix does not, if possible, exceed 2.5°.

The compromise solution devised by the applicant applies to fiber lengths, which if possible do not overly exceed 40 mm, as well as to opening rollers, whose outer diameter of the combing means lies in the standard modern range of between 40 to 60 mm. With an outer diameter of, for example, 60 mm, the compromise involves two to three threads, while at an outer diameter of, for example, 80 mm, the range is three to four threads. The above mentioned rules for calculation are to be so understood in that the number of threads is to be chosen which is nearest to the calculated value. As a rule, the empirical formula will result in fractions, which are then rounded up or down accordingly. The rules of calculation also take into consideration the fact that the helix-shaped extending saw teeth rows should have a groove width between them which measures 2 mm, measured at the tooth tips.

These and further objects, features and advantages of the present invention will become more readily apparent from the following detailed description thereof when taken in conjunction with the accompanying drawings.

DETAILED DESCRIPTION OF THE DRAWINGS

Figure 1:
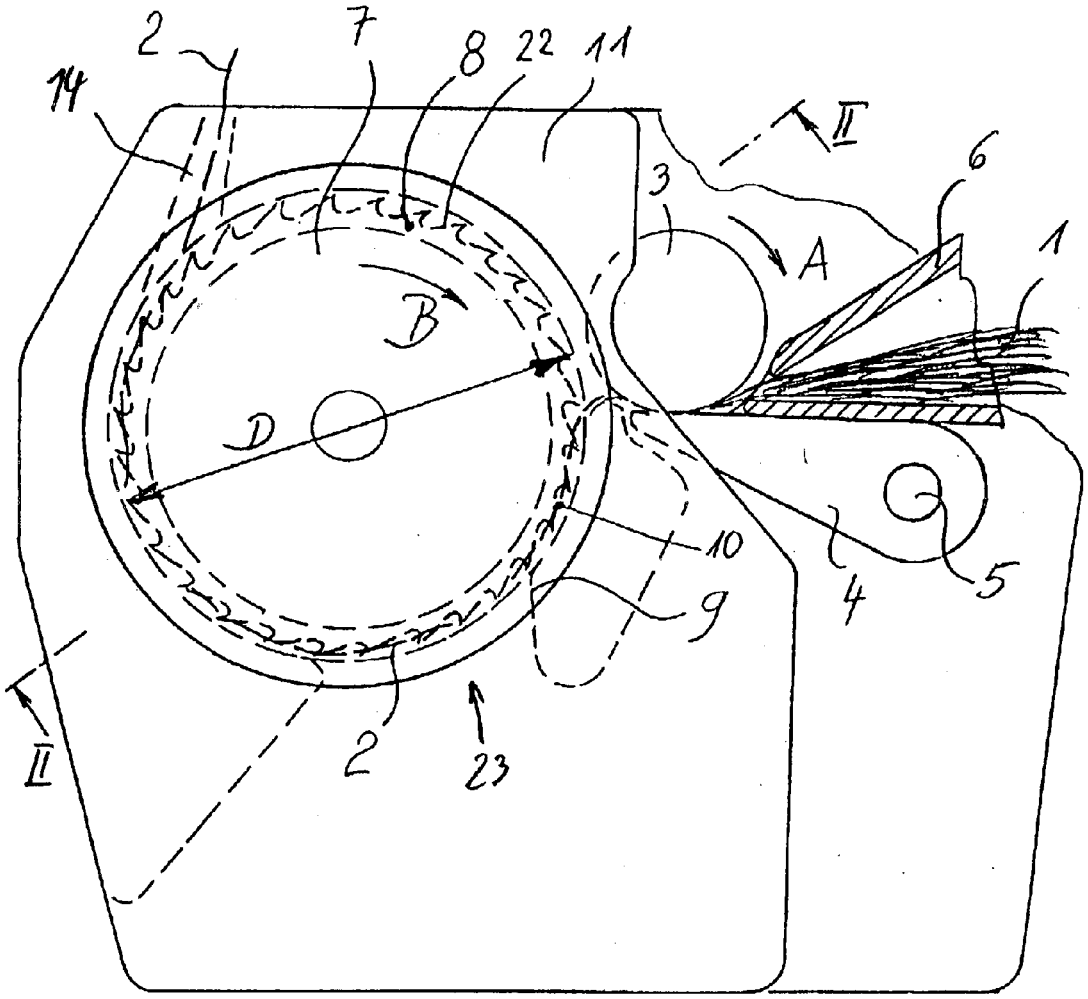
FIG. 1 is a side view of an opening device comprising an opening roller constructed according to a preferred embodiment of the present invention.
Figure 2:
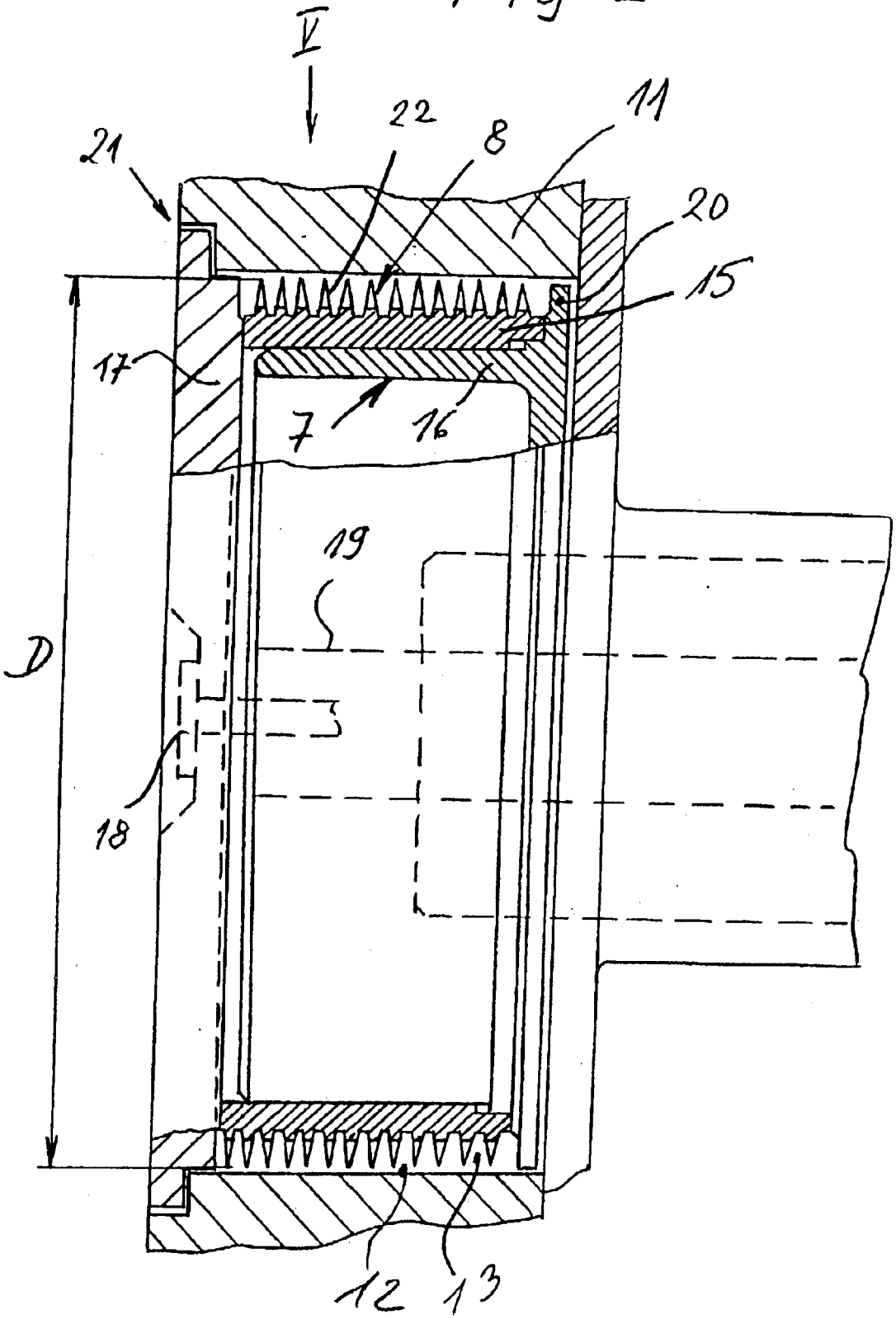
FIG. 2 is, in somewhat enlarged dimensions, a sectional view along the intersectional surface II—II of FIG. 1.

An opening device according to FIGS. 1 and 2 is part of a spinning machine (not shown in any further detail), for example an open-end spinning machine. The opening device serves the feeding of a sliver 1 and its opening to single fibers 2. For this purpose, among other components, a feed roller 3 driven in rotational direction A is provided, to which a feed table 4 can be pressed in a flexible way. The feed table 4 can be swivelled around a swivel axle 5 and loaded against the feed roller 3 by a loading spring (not shown). A nipping line is thus formed between the feed roller 3 and the feed table 4, to which nipping line the sliver 1 is nipped during its transport. An entry funnel 6 for the sliver 1 is arranged upstream of the feed roller 3.

The feed roller 3 presents the sliver 1 to be opened to single fibers 2 to a significantly faster driven opening roller 7, which is driven in the same direction as the feed roller 3 in rotational direction B. The opening roller 7 is provided with combing means 8, which takes the form of a saw-toothed helix (helical line) having multiple thread grooves and which is described in more detail below and has an outer diameter D.

A fiber beard support 9 is arranged between the feed table 4 and the opening roller 7, which fiber beard support 9 presses in the end of the sliver 1 to be opened, the so-called fiber beard 10, from the rear side in the opening means 8 of the opening roller 7.

The above mentioned components are arranged in an opening roller housing 11. This has at least one peripheral surface 12, which surrounds the opening roller 7 over a part of its circumference while forming an annular space 13. A fiber feed channel 14 starts in the opening roller housing 11, which channel 14 feeds the opened single fibers 2 from the opening means 8 of the opening roller 7 to a spinning rotor (not shown). The spinning rotor and thus the annular space 13 are connected to a vacuum source which serves the transport of the single fibers 2.

The opening roller 7 comprises an exchangeable combing means support 15 in the form of a combing ring, which comprises the opening means 8 and which is slid onto a base body 16 of the opening roller 7. A tension disc 17 serves to affix the combing means support 15 onto the base body 16, which disc 17 is at the same time a lateral collar of the opening roller 7 and is affixed by means of a screw 18 on a shaft 19 of the opening roller 7. The tension disc 17 tensions the combing means support 15 against a flange 20 of the base body 16.

The tension disc 17 is exposed directly to the atmosphere. The opening roller 7 is sealed off from the annular space 13 by means of a labyrinth seal 21.

It is known from prior art that a saw-toothed wire can be wound in helix form around the periphery of the opening roller 7 to form the combing means 8. It is further known that the combing means 8 can be ground into the periphery of the opening roller 7 or the periphery of a combing means support 15 belonging to the opening roller 7, whereby then parallel, helix-shaped rows of teeth 22 which may have multiple thread grooves, are formed.

Opening rollers 7 rotate at speeds of up to 8,000 rpm, whereby the teeth 22 rotate at circumferential speeds of up to 30 m per second. The teeth 22 of the combing means 8 penetrate the fiber beard 10 and comb it. Hereby single fibers 2 are pulled out of the fiber beard 10 as soon as the taking along force of the opening roller 8 is greater than the arresting forces of the single fibers 2. The single fibers 2 are then further accelerated around the periphery of the opening roller 7 and after approximately 180° are then fed via the fiber feed channel 14 arranged tangentially downstream of the opening roller 7 to the spinning rotor.

The acceleration of the single fibers 2 is effected by the forces of friction exerted by the teeth 22 of the combing means 8 and is supported by air currents which the opening roller 7 generates and which are intensified by the applied vacuum at the end (not shown) of the fiber feed channel 14. The air currents are suctioned in via an air entry opening 23.

Figure 3:
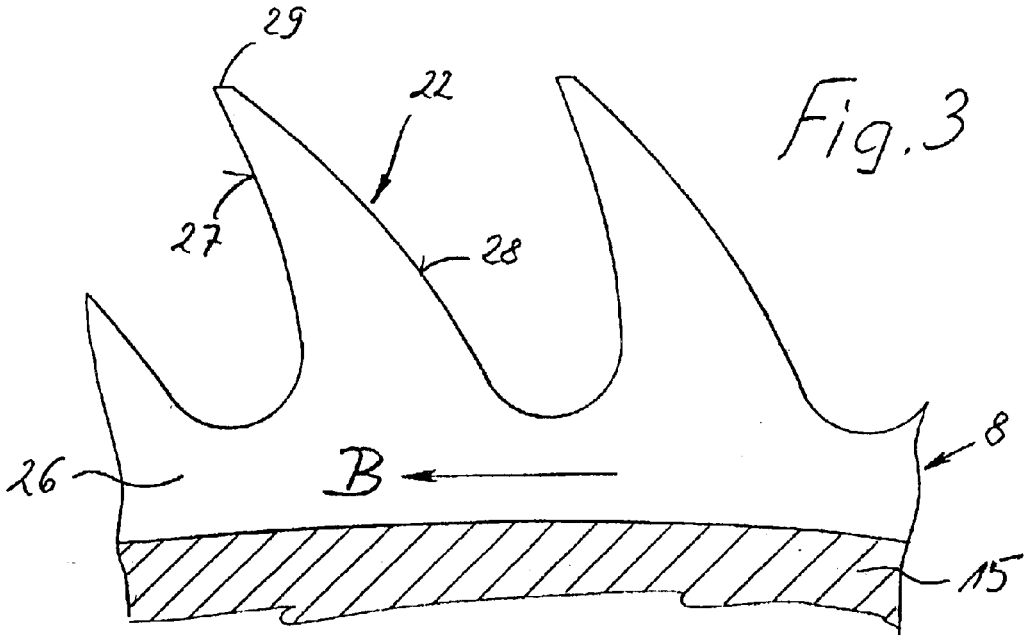
FIG. 3 depicts, two teeth of an opening means at approximately twenty times the original size, in a view according to FIG. 1.
Figure 4:
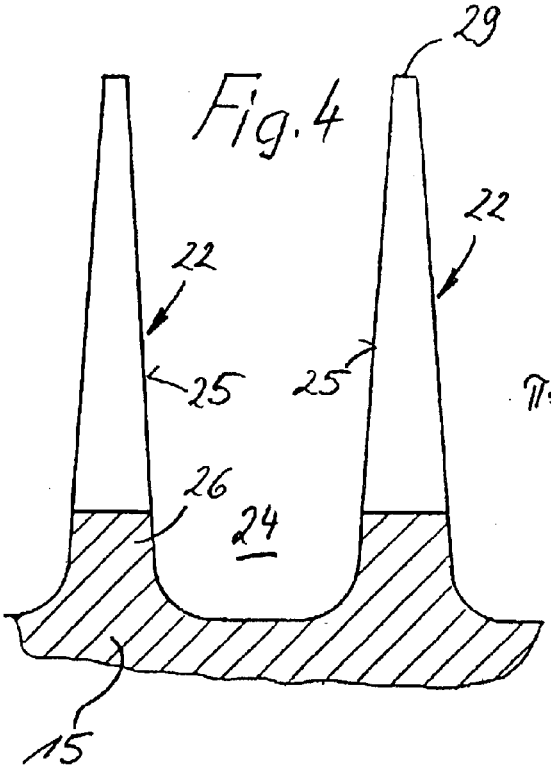
FIG. 4 depicts two teeth of an opening means also at approximately twenty times the original size, in a view according to FIG. 2.

In FIGS. 3 and 4, enlarged to approximately twenty times their original size, the teeth 22 of the opening means 8 are more clearly shown. During transport around the periphery of the opening roller 7, the single fibers 2 are located in grooves 24 between the teeth 22, whereby the single fibers 2 are taken along and accelerated in rotational direction B by the teeth flanks 25, in particular by friction forces.

The grooves 24 are bordered by closed teeth bases 26, from which the actual teeth 22 then rise, comprising a tooth front 27, a tooth back 28, two lateral tooth flanks 25 and these linking tooth tips 29.

As already mentioned above, several contradictory requirements are to be fulfilled in a compromise according to the present invention. One requirement is to reduce the speed of the opening roller 7 in that the helix-shaped opening means 8 is designed with multiple thread grooves in order to increase the combing performance. On the other hand, the number of threads and also the angle of inclination of the helix are to be limited so that the opening means 8 do not become overly aggressive during combing of the fiber beard 10.

Figure 5:
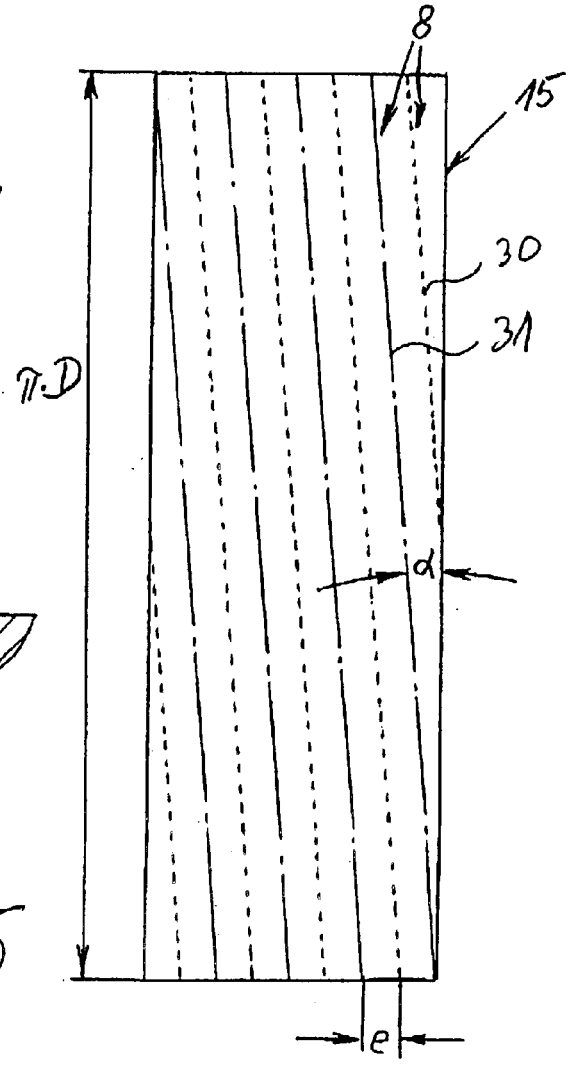
FIG. 5 is a scaled down depiction of a view onto a combing means support in the direction V of FIG. 2, shown as a developed view.

The explanation of the present invention is best defined in the scaled-down FIG. 5, which is shown as the developed view of an opening means 8. This can be seen from the larger side of the rectangle, for which the measurement $\pi \cdot D$ is given, whereby D is the outer diameter of the opening means 8, as described above.

In FIG. 5, a helix consisting of two threads 30 and 31 is shown, whereby the thread 30 is a dotted line and the thread 31 is a dot-dash line. These threads 30 and 31 can be imagined as rows of teeth 22, whereby the distance between two adjacent tooth tips 29 defines the so-called groove width e, which lies in the order of magnitude of approximately 2 mm.

The compromise reached through tests and calculation is such that the number of the threads 30,31—or other threads not shown—measures approximately between one twentieth to one thirtieth of the outer diameter D, expressed in millimeters, of the opening means 8, and that the angle of inclination $\alpha$ of the helix, expressed in degrees, measures 0.5 to 0.7 times the number of threads 30,31. It should be taken into consideration hereby that the angle of inclination $\alpha$ of the helix does not exceed 2.5°, so that the opening means 8 does not become too aggressive.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A support for a combing means for an opening roller, comprising an opening means designed as a saw-toothed-shaped helix having multiple thread grooves, wherein the number of threads forming the thread grooves therebetween amounts to between one twentieth to one thirtieth of the outer diameter of the combing means (measured in millimeters), and wherein the angle of inclination (measured in degrees) of the helix amounts to between 0.5 to 0.7 times the number of threads.

2. A support for a combing means for an opening roller according to claim 1, wherein the angle of inclination of the helix does not exceed 2.5°.

3. A combing ring according to claim 2, wherein the angle of inclination ($\alpha$) of the helix does not exceed 2.5°.

4. A support for a combing means of an opening roller according to claim 1, wherein said opening means has a diameter of between 40 mm and 80 mm.

5. A combing ring for an opening roller of an open end spinning machine, comprising;

a ring base, and combing structure on the periphery of the ring base, said combing structure including a saw-toothed shaped helix having a plurality of threads forming thread grooves therebetween, wherein the number of threads amounts to between one twentieth to one thirtieth of the outer diameter of the combing means (measured in millimeters) and wherein the angle of inclination (measured in degrees) of the helix amounts to between 0.5 to 0.7 times the number of threads.

6. A method of making a combing ring for an opening roller of an open end spinning machine, comprising;

forming a ring base, and machining a combing structure on the periphery of the ring base said combing structure including a saw-toothed shaped helix having a plurality of threads forming thread grooves therebetween, wherein the number of threads amounts to between one twentieth to one thirtieth of the outer diameter of the combing means (measured in millimeters) and wherein the angle of inclination (measured in degrees) of the helix amounts to between 0.5 to 0.7 times the number of threads.

7. A method according to claim 6, wherein the angle of inclination ($\alpha$) of the helix does not exceed 2.5°.

8. A method of making yarn comprising:

opening sliver into individual fibers, and feeding said fibers to an open end spinning rotor, said opening of sliver being performed using a combing ring of an opening roller which includes:

a ring base, and combing structure on the periphery of the ring base, said combing structure including a saw-toothed shaped helix having a plurality of threads forming thread grooves therebetween, wherein the number of threads amounts to between one twentieth to one thirtieth of the outer diameter of the combing means (measured in millimeters) and wherein the angle of inclination (measured in degrees) of the helix amounts to between 0.5 to 0.7 times the number of threads.

9. A method according to claim 8, wherein the angle of inclination ($\alpha$) of the helix does not exceed 2.5°.

* * * * *